United States Patent [19]

Hermes

[11] 4,115,054

[45] *Sep. 19, 1978

[54] PROCESS FOR THE RAPID, CONTINUOUS AND WATERLESS DYEING AND TEXTURIZING AND HEAT-SETTING TEXTILE AND PLASTIC MATERIALS

[75] Inventor: Julius Hermes, Martinsville, Va.

[73] Assignee: Martin Processing, Inc., Martinsville, Va.

[ * ] Notice: The portion of the term of this patent subsequent to Sep. 13, 1994 has been disclaimed.

[21] Appl. No.: 750,910

[22] Filed: Dec. 15, 1976

Related U.S. Application Data

[63] Continuation-in-part of Ser. No. 647,775, Jan. 9, 1976, Pat. No. 4,047,889.

[51] Int. Cl.[2] ..... C09B 67/00; D02G 1/00; D06P 1/64

[52] U.S. Cl. ..... 8/17; 8/4; 8/93; 8/173; 28/247; 264/342 R

[58] Field of Search ..... 8/93, 173, 147, 158, 8/17, 4; 264/342 R; 28/247

[56] References Cited

U.S. PATENT DOCUMENTS

| | | | |
|---|---|---|---|
| Re. 27,773 | 10/1973 | Hermes | 8/130.1 |
| 2,938,811 | 5/1960 | Hermes | 428/269 |
| 3,530,214 | 9/1970 | Hermes | 264/342 |
| 3,943,105 | 3/1976 | Hermes | 260/47 C |
| 4,047,889 | 9/1977 | Hermes | 8/93 |

*Primary Examiner*—John Kight, III

*Attorney, Agent, or Firm*—Stevens, Davis, Miller & Mosher

[57] ABSTRACT

A process is disclosed for the rapid, continuous and waterless dyeing of textile and plastic materials in which the dyestuff is dissolved, suspended or dispersed in a high boiling solvent, such as glycol or glycol ether, for carrying out the dyeing step per se, after which the dye textile or plastic material (after cooling if desired) is subjected to a washing with a low boiling organic liquid such as methanol or ethanol (preferably the former) or a chlorinated hydrocarbon solvent, and subsequently dried. The entire series of operations is carried out under nonaqueous or substantially nonaqueous conditions with the complete or substantially complete recovery and recycling of the used dyestuff, the used high boiling solvent, and the used low boiling organic wash liquid.

22 Claims, 2 Drawing Figures

Figure 1:
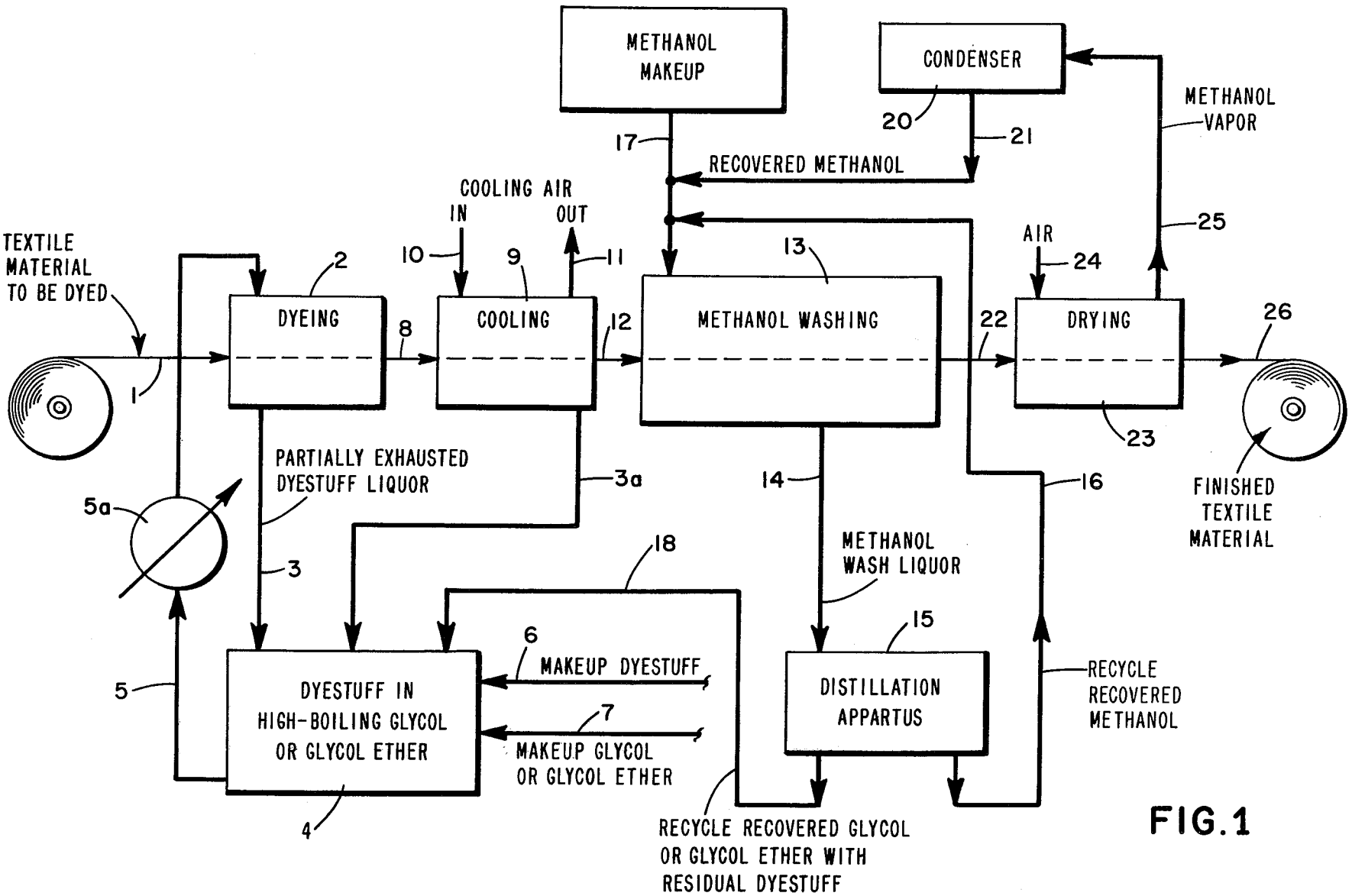

PROCESS FOR THE RAPID, CONTINUOUS AND WATERLESS DYEING AND TEXTURIZING AND HEAT-SETTING OF TEXTILE AND PLASTIC MATERIALS

This application includes improvements over the invention described and claimed in my prior copending application Ser. No. 647,775, filed Jan. 9, 1976, now U.S. Pat. No. 4,047,889, and so is a continuation-in-part of that prior application.

That prior copending application describes a process for the rapid, continuous and waterless dyeing of textile and plastic materials in an essentially closed system, with treatment of the textile or plastic material with a dyestuff dissolved, suspended or dispersed in a high boiling solvent for carrying out the dyeing step, followed by cooling and then washing with a low boiling organic liquid such as methanol or ethanol, followed finally by drying. The high boiling organic solvent, the low boiling organic liquid, and the dyestuff are recovered and recycled in an essentially closed system with resulting advantages in minimizing or eliminating water and air pollution with heretofore have created serious environmental problems.

In addition, the process of the prior application offers distinct advantages in these energy-conscious days by providing substantial economies with respect to the energy requirements for the process.

According to further improvements, the dyeing procedure of the above-mentioned copending application may, if desired, be effectively combined, when treating a textile material such as a woven or knitted fabric, with a texturizing and heat-setting operation thereby resulting in a still further improved textile finishing operation that combines both texturizing and heat-setting on the one hand with dyeing on the other hand, all in one combined operation and therefore with very substantial savings in processing costs.

Additionally, by omitting the dyestuff during the procedure mentioned in the preceding paragraph, one may very effectively achieve a texturizing and heat-setting, only, of the textile material.

In what follows, the rapid, continuous and waterless or essentially waterless dyeing of textile and plastic materials will be described substantially as described in my prior copending application with only minor changes, after which the still further improvements will be described.

With the current emphasis upon pollution control, it is evident that more effective measures for pollution control are becoming increasingly necessary in view of the stringency of such controls, to say nothing of the cost. In the case of dye plants, it is extremely expensive to treat the effluents from such plants and in some cases a treatment sufficient to bring about approval by environmental protection authorities for the discharge of effluents from the dye plants into ground water (whether in the form of rivers or wells or the like) is in fact prohibitively expensive. Indeed, there are communities throughout various parts of the world that do not allow dyeing and finishing plants to be located within their borders.

The present invention has for one of its objects a process for dyeing textile and plastic materials that will eliminate all polluting effluents as well as air pollution that might otherwise result from the dyeing operation.

After the initial capital expenditure for the necessary machinery, the process described hereinafter is relatively inexpensive and moreover requires considerably less energy to keep it in operation. The latter feature is in and of itself a further extremely attractive feature of the process in these critical days of energy shortages.

The process of the present invention in one of its embodiments involves dyeing the textile or plastic material with the dyestuff dissolved, suspended or dispersed in a relatively high boiling liquid such as a glycol or glycol ether, and after the dyeing operation washing the dyed material in a relatively low boiling organic liquid such as methanol or ethanol or a relatively low boiling chlorinated hydrocarbon solvent such as $CH_2Cl_2$, $CCl_4$ or $CHCl_3$. The wash liquor is then subjected to suitable treatment for recovery and/or separation of the components thereof, such as by distillation at a relatively low temperature, which enables the low boiling organic liquid to be taken over as vapor and thereafter readily condensed, while the high boiling liquid and residual color or dyestuff remain. The distilled low boiling organic liquid is recovered and continuously recycled through the washing apparatus while the high boiling liquid containing the residual color is recycled through the dyeing apparatus after suitably replenishing the color or dyestuff which has been absorbed by the textile material passing through the process.

The dyeing process described herein is particularly desirable in connection with the dyeing of polyester textile materials, by which is meant a textile material based upon polyethylene terephthalate or the like, but is not limited to the dyeing of such materials. It may be applied to the dyeing of nylon, acrylic, or other well known commercial textile materials, including materials of natural origin such as wool or cotton.

The textile material undergoing any of the treatments described hereinafter may be in any of the conventional forms well known in the art, such as continuous filament yarn, staple yarn, tow, woven or knitted fabric or the like. The yarn may be in the form of a warp of yarn comprising dozens or even hundreds of individual yarn ends.

Although the dyeing of polyester material has advanced considerably in recent years, in most cases it is still necessary to use dyeing assistants such as phenol derivatives. These phenol derivatives are extremely difficult to remove from the effluents of the dyeing operation, and accordingly, the present process represents an especially attractive way of avoiding difficulties from this particular source. Moreover, the instant dyeing process allows a textile plant, and especially the dyehouse, to be located in a water-poor area.

After the textile material has been washed in the low boiling organic liquid, such as methanol, for example, the textile material is passed into a low temperature dryer in order to remove and recover all traces of methanol.

Although the dyeing step per se may be carried out in any desired manner, one particularly effective way of doing so without departing from the spirit and scope of the present invention is to proceed as described in connection with the apparatus disclosed in my U.S. Pat. No. 3,558,260, granted Jan. 26, 1971. Alternatively, the apparatus disclosed in my copending application Ser. No. 713,259, filed Aug. 10, 1976, may also be employed.

After the textile material leaves the dyeing apparatus, it is preferably passed through a cooling zone where its temperature is reduced from an elevated temperature just below the boiling point of the low boiling organic solvent to (for example) about 140° F. after which it is then passed through a washer where it is washed with the low boiling organic liquid such as (and preferably) methanol.

The washing step may be carried out in any conventional manner, although preferably I employ a cascade washing system involving a series of washing steps according to which the methanol is introduced just ahead of the point where the textile or plastic material leaves the washer and then is passed concurrently with respect to the direction of movement of the textile material and through a series of "cascade" zones back to a point just after the textile material enters the washing apparatus where the concentration of high boiling liquid and residual unfixed color or dyestuff carried therein is the greatest.

The methanol or other low boiling organic wash liquor is then passed to a suitable separatory device such as distillation apparatus where the methanol is distilled off at a relatively low temperature, condensed, and then returned to the methanol washing device.

The textile material after passing through the low boiling organic liquid washing device is then passed into a low temperature dryer to evaporate residual low boiling organic liquid (e.g., methanol) still clinging to the textile material. The methanol thus evaporated is passed overhead to a condenser where it is condensed and, if desired, returned to the methanol washing step.

The textile material then leaves the dryer in finished form ready for such further treatment as any dyed textile material may be conventionally subjected to thereafter.

As indicated above, the partially exhausted dyestuff liquor leaving the dyeing step is recycled to the dyeing step, after addition of make-up dyestuff as desired and/or make-up glycol or glycol ether as desired, as well as with the addition of the glycol or glycol ether recovered from the distillation apparatus.

After a given dyelot of textile material has been completed, the glycol or glycol ether containing the dyestuff may be separately stored and used again when a similar shade of dyeing is to be repeated. In the meantime, the dyeing apparatus can be cleaned very readily with the low boiling organic liquid, such as methanol, and the methanol thus employed may be returned to the distillation unit for purification and separation and recycling to the methanol washing step for the next dyelot.

The process of this embodiment of the present invention may be further illustrated by reference to the accompanying drawings where (in FIG. 1) the various steps are shown in schematic fashion.

Reference numeral 1 represents the incoming textile material to be dyed which passes into the dyeing apparatus 2. There it is subjected to the action of an appropriate dyestuff dissolved, suspended or dispersed in a suitable high boiling organic liquid such as ethylene glycol, diethylene glycol, triethylene glycol, tetraethylene glycol, propylene glycol, or the methyl- or ethyl-mono- or di-ether of such glycols.

The partially exhausted dyestuff liquor is removed from the dyeing apparatus 2 via line 3 from which it passes to a storage chamber or sump 4 for the residual dyestuff-high boiling liquid mixture. From sump 4 the dyestuff-high boiling liquid mixture is recycled via line 5 to the dyeing apparatus 2, passing through a conventional heat exchanger 5a to adjust it to the desired temperature of dyeing.

Make-up dyestuff is added when and as needed via line 6 and make-up high boiling liquid is added when and as needed via line 7.

The textile material passes from the dyeing chamber via line 8 to a cooling chamber 9. There the dyed textile material is cooled from a temperature of just below the normal boiling point of the high boiling organic solvent down to a temperature of (for example) about 140° F by passing cooling air into the cooling chamber 9 via line 10 and out via line 11. Excess non-fixed dyestuff and excess high boiling liquid is removed from the textile material by conventional means (not shown) such as by passing the textile material between squeeze rolls near the exit end of the cooling chamber 9. This excess non-fixed dyestuff in admixture with the excess high boiling liquid is returned to the dyestuff liquor sump 4 via line 3*a*.

The dyed material, now cooled and at least partially freed of excess non-fixed dyestuff and excess high boiling liquid, is shown at 12 as passing into a low boiling organic liquid washing device 13 where it is subjected to washing to remove residual high boiling liquid and residual (non-fixed) dyestuff. The organic wash liquid may conveniently be methanol or other low boiling aliphatic alcohol or a chlorinated hydrocarbon of the kind mentioned above. Methanol is preferred.

Wash liquor leaves the methanol washer 13 via line 14 and is passed to recovery apparatus 15 which may suitably take the form of distillation apparatus. There the relatively volatile low boiling organic liquid, such as methanol, is distilled away from the high boiling liquid, condensed and returned via line 16 to the methanol washing apparatus 13. Make-up methanol may be introduced when and as needed via line 17.

Returning to the separatory or distillation apparatus 15, the recovered high boiling organic liquid with the residual dyestuff which remains after the vaporization of the methanol therefrom is recycled via line 18 to the partially exhausted dyestuff liquor sump 4, whereby it is returned to the dyeing operation carried out in dyeing apparatus 2.

The textile material after the washing step is passed as shown by reference numeral 22 into the dryer 23 where it is contacted with air introduced via line 24. This air may be warm or hot, as obtained from a heating device (not shown). The air passes through and/or in contact with the washed textile material picking up residual low boiling organic liquid still clinging to the textile material, and leaves the drying device 23 via line 25. The air leaving air line 25, and carrying vapors of the low boiling organic liquid, is then passed into a condenser 20 where the low boiling organic liquid is recovered and recycled to the methanol washing step via line 21. The air is removed from the condenser 20 via conventional vent mans not shown. Alternatively, the methanol vapor (with residual air) leaving via line 25 may be separately disposed of, such as by burning in a waste heat boiler (not shown) to effect still further economies in operation.

In this manner the dyed, (optionally) cooled, washed and dried textile or plastic material leaves the dryer 23 as shown at 26 as a finished dyed textile or plastic material ready for such other textile treating operations as may be desired.

It will be noted from the description of the schematic drawing of FIG. 1 thus described that the material flow is completely cyclic in nature with no or essentially no liquid effluents from the system. Consequently, the system is completely free from problems normally associated with dye plants where aqueous or largely aqueous systems are involved and wherein the aqueous systems at some point or another must be discharged from the plant into rivers or wells or other surface water thereby creating effluent problems of an environmentally undesirable nature. Moreover, the use of the low boiling organic liquid for washing purposes requires a significantly lesser energy input to the system, which is an additional highly desirable feature of the process.

By way of still further illustration, the following examples of dyeing are set forth.

EXAMPLE 1

A nylon fabric, type 66, is dyed in ethylene glycol containing ½% of Acid Blue #25. The sample is dyed at 300° F for 12 seconds. After cooling, the same is washed in methanol and then dried at a low temperature. This dyeing gives a heavy blue shade with much better fastness properties than dyeing by conventional methods. Moreover, the partially exhausted dyestuff liquor after addition of makeup ethylene glycol is returned to the dyeing operation. The wash methanol is distilled for recovery and recycling of recovered methanol.

EXAMPLE 2

A polyester fabric is dyed in a dye-liquor containing ethylene glycol and ½% of Disperse Blue #56. The polyester material is dyed at 320° F for 30 seconds. After dyeing, the sample is then washed in methanol and dried at a low temperature. The dyeing results in a full blue with excellent fastness properties. Separation and recovery of both the ethylene glycol and methanol may be as described above.

EXAMPLE 3

A wool fabric is dyed in ethylene glycol containing ½% of Acid Blue #25. The sample is dyed at 300° F for 12 seconds. After cooling, the sample is washed in methanol and then dried at a low temperature. This dyeing gives a heavy blue shade with much better fastness properties than dyeing by conventional methods. Moreover, the partially exhausted dyestuff liquor after addition of makeup ethylene glycol is returned to the dyeing operation. The wash methanol is distilled for recovery and recycling of recovered material in the manner described above.

EXAMPLE 4

An acrylic fabric is dyed in a dye-liquor containing ethylene glycol and ½% of Disperse Blue #56. The acrylic material is dyed at 320° F for 30 seconds. After dyeing, the sample is then washed in methanol and dried at a low temperature. The dyeing results in a full blue with excellent fastness properties. Separation and recovery of both the ethylene glycol and methanol may be as described above.

It should be noted in passing that I do not claim to be the first to have suggested the step of dyeing a textile material in a nonaqueous dye bath such as a glycol or a glycol ether. Societa Rhodiaceta's French Pat. No, 955,260 (and the generally corresponding Swiss Pat. No. 230,891) suggested such a step for the dyeing of nylon many years ago. Moreover, more recently Laucius et al, in U.S. Pat. No. 2,882,119, suggested the dyeing of polyester in a nonaqueous dyebath comprising various glycols. See also Olpin et al U.S. Pat. No. 2,461,612. Moreover, I do not claim to be the first to suggest the step per se of washing dyed textile products with a low boiling organic liquid, such as an alcohol, because that too was suggested in the Societa Rhodiaceta patents mentioned above, although there it is a matter of indifference whether water or a low boiling alcohol is employed as the washing liquid. See the French patent at page 2, lines 58 et seq. However, neither the prior art just cited nor any other prior art, so far as I am aware, has suggested, much less recognized, the desirability of operating the dyeing and washing steps in the manner indicated herein with complete or substantially complete recycling of the various materials involved and with a completely or substantially completely nonaqueous system, for the sake of lesser costs, and more importantly, with a view to present-day environmental and energy conservation considerations.

It is to be particularly noted in connection with this embodiment of the present invention that it conveniently provides what is in effect a nonaqueous or substantially nonaqueous closed or essentially closed treating system, and therefore with no need to discharge potentially polluting aqueous wastes to ground water. If as a result of long-continued operation, a build-up of significant (though still relatively small) amounts of water should occur, such as from the use of aqueous dye concentrates to make up the dilute dyestuff-high boiling organic liquid treating solution and/or from moisture unavoidably present in the air used for the cooling and drying steps, such water can be easily removed from any of the treating liquids by conventional means (not shown) such as by passing same through a bed of a commercial dehydrating agent such as Drierite.

The description up to this point has dealt primarily with dyeing alone. Hereinafter descriptive matter relating to dyeing combined with texturizing, as well as descriptive matter relating to texturing alone, is presented.

Texturizing, etc. In the case of a textile material such as woven or knitted fabric, as distinguished from a plastic material in the form of a film, the surface-to-volume ratio is substantially higher due to the yarn structure of the woven or knitted textile material. Consequently, there will normally be a certain amount of moisture pickup from the atmosphere so that at least some texturizing and heat-setting will take place when the textile material is brought into contact with the hot high boiling organic liquid.

Generally, however, where it is desired to secure a really significant degree of texturizing and heat-setting simultaneously with the dyeing, a pre-treatment of the textile material to incorporate therein a low boiling liquid texturizing agent will be preferred. This objective is achieved very conveniently by simply passing the woven or knitted textile material through a bath of low boiling liquid texturizing agent (such as water or methanol) so as to incorporate therein a predetermined amount of low boiling liquid texturizing agent, such as of the order of 10 to 60%, on a weight basis. Where water is selected as the low boiling liquid texturizing agent, a convenient way of incorporating the desired amount of water in the woven or knitted textile material is to contact same with steam from a series of steam jets, or else with very fine jets of water, with the jets placed above and/or below the path of travel of the textile material just prior to its contact with the hot high boiling organic liquid; for example, as the woven or knitted textile material is introduced into the process via an otherwise conventional tenter-frame arrangement.

Thus, in order to effect the texturizing and heat-setting mentioned above, the textile material undergoing processing is first treated with a low boiling texturizing agent, such as water or methanol in the liquid phase, or in the case of water, in the form of steam or very fine sprays. The amount of low boiling texturizing agent employed for this purpose will vary, depending on the degree of texturizing desired. It is preferably in the range of from 10 to 60% by weight, based on the weight of the textile material. It is of course necessary to employ sufficient of the low boiling texturizing agent to impart the desired degree of texturizing and heat-setting, while at the other extreme it is necessary to avoid employing so much as to defeat the purpose of the texturizing operation. The amount, in any case, will be such that when the textile material containing the low boiling texturizing agent in liquid phase is subjected to the hot dyestuff-containing high boiling organic solvent, this brings about an "explosion", as it were, or a flashing of the low boiling liquid to vapor, thus producing a volumization or bulking of the textile material. The net result of this procedure is to bring about the desired texturizing and heat-setting of the textile material while it is being dyed.

Figure 2:
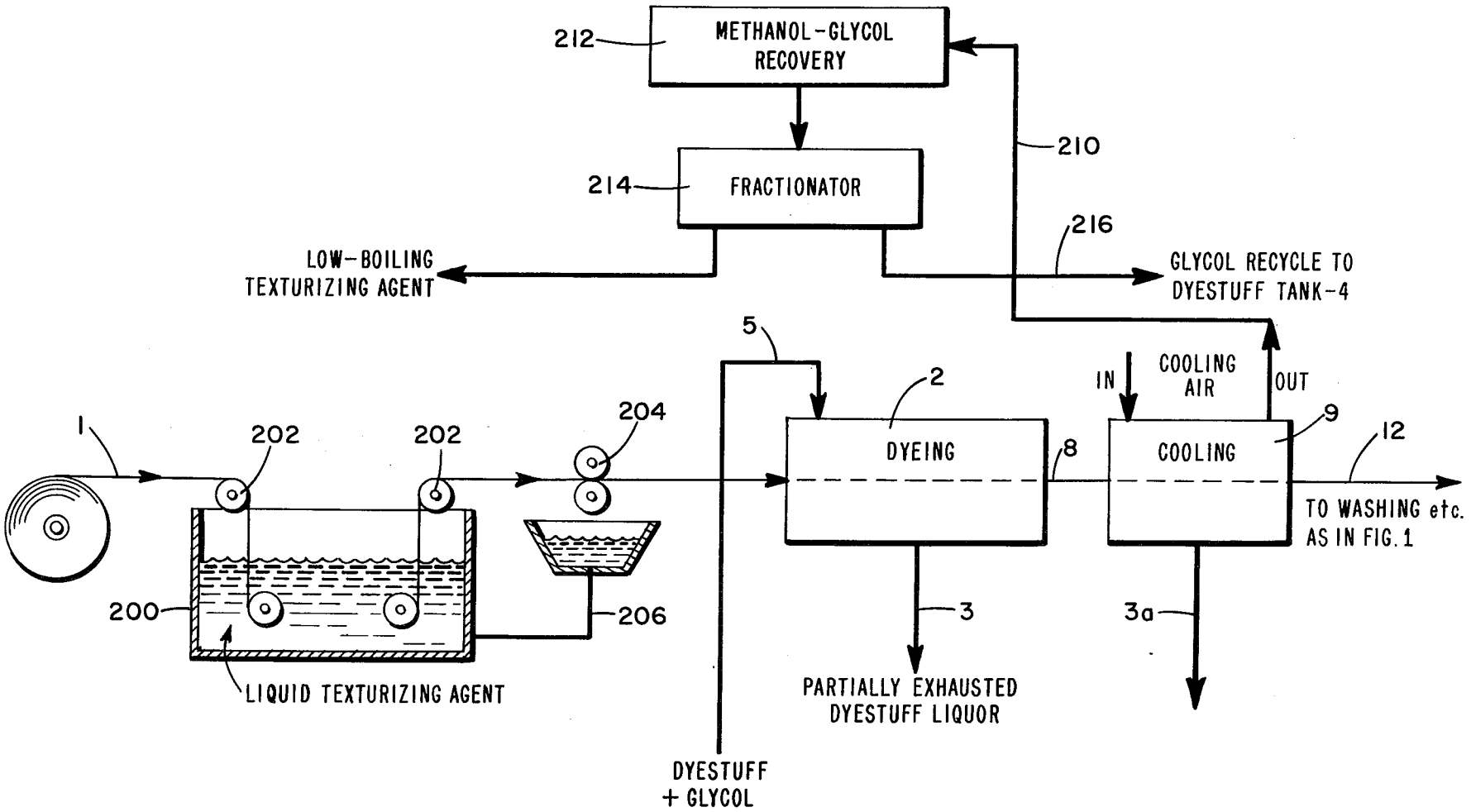

As shown in FIG. 2, the textile material is first passed through a trough 200 containing the low boiling liquid texturizing agent by means of a series of guide rolls 202, and thence between squeeze rolls 204 by means of which the liquid texturizing agent in excess of the desired predetermined amount to be left in the textile material is removed and (in the case of methanol) returned to the trough 200 via line 206. When methanol is used, suitable hoods or enclosures (not shown) are provided for the protection of the workmen and to minimize any fire hazard. The thus-treated textile material is then passed to the dyeing step 2 and the succeeding steps of FIG. 1 as a consequence of which texturizing and heat-setting are combined with dyeing.

The low boiling texturizing agent present in the textile material in liquid phase, and which thereafter is subjected to the relatively high temperature of the hot dyestuff-containing high boilng organic solvent in 2, flashes off during the dyeing operation and is removed via line 210. This low boiling liquid which is flashed off in the form of vapor will then be associated with some vapor of the high boiling organic solvent such as glycol, some of which indeed may be present in the form of particles of "mist". This mixture is passed through a recovery system which may take the form of a condenser and/or filter 212, thereby assuring the separation and removal of substantially all of the high boiling organic solvent including the mist particles. The condensate and/or filtrate may then be passed to a fractionator 214 for the removal of substantially all of the low boiling liquid, with the remaining high boiling organic solvent being recycled to the dyestuff sump 4 via line 216. The low boiling liquid (if methanol) is thus separated and reused, or in the case of water, it will be evaporated from the high boiling liquid in the dyestuff sump 4. In the event the low boiling texturizing agent is methanol, the reclaimed methanol may be conveniently condensed and recycled for use at a later stage of the process such as in the washing step. On the other hand, the reclaimed methanol without condensation may be sent directly to a waste heat boiler where it can be burned, thereby reducing the energy requirements for the system derived from the burning of valuable fossil fuels.

Alternatively, the low boiling texturizing agent may be introduced into the textile material in the desired predetermined amounts, via sprays of fine jets of liquid water or methanol, or jets of steam, located above and/or below the path of travel of the textile material just prior to its introduction to the dyeing step 2 of FIG. 1.

The texturizing and heat-setting is performed under controlled conditions of a predetermined relatively high temperature and a predetermined content of low boiling liquid texturizing agent. The textile material when in the form of woven or knitted goods may be conveniently introduced into the process by means of a conventional tenter-frame that can be adjusted to overfeed the textile material lengthwise, and including also provision for narrowing the tenter-frame to texturize widthwise as well. In this way the degree of texturizing and heat-setting in either the length direction or the width direction (or both) may readily be controlled.

As a still further embodiment of the invention, if one wishes only to texturize and heat-set the textile material without at the same time dyeing same, one need only refrain from adding a dyestuff to the high boiling organic liquid and instead otherwise proceed as already described above, with a pre-treatment such as in FIG. 2 followed by treatment as in FIG. 1.

Most texturizing yarns for weaving or knitting are in the 100 denier range. The actual cost of separately texturing 100 denier yarn is about $0.22 per pound. To texturize a 30 denier yarn costs about $1.10 per pound, since the machine time for 30 denier yarn is about four times the machine time for 100 denier yarn for equivalent number of pounds produced. At the present time, due to high cost there are no fabrics available made from texturized 30 denier yarns. By weaving or knitting an untexturized 30 denier yarn and then texturizing the resulting woven or knitted article as described herein, the texturizing can be done at substantially no additional cost during the dyeing operation. The remarkable savings thus made possible by the present improved operation combining both texturizing and dyeing offer vast possibilities for increased markets for texturized and heat-set woven and knitted textile materials of the finest denier. Consequently, the industry will have available a wider selection of textile materials readily adaptable for fabrication into natural-silk-like articles of manufacture.

It should be mentioned that when the procedures described herein include a texturizing and heat-setting operation, either alone or in combination with dyeing, it is important that the textile material shall be in a relaxed or relatively untensioned condition during the texturizing. This can be assured by supporting the textile material on an endless traveling tenter-frame.

It will be understood that no claim is made broadly to texturizing per se, since such texturizing has long been known; e.g., see my U.S. Reissue Pat. No. Re. 27,773. The treatment described herein may also have the additional beneficial effect of minimizing pilling when treating, e.g., polyester—see my U.S. Pat. No. 2,938,811.

Still further details on texturizing are as follows: Texturizing and voluminizing are performed on a Hermesol machine (see my copending application Ser. No. 713,259, filed Aug. 10, 1976). The greige goods coming off the loom or knitting machine are fed into a tenter-frame, with overfeeding of the material. On the way to the dyeing chamber, the textile material is wetted between 20 and 60% with a low boiling solvent. As the tenter-frame enters the Hermesol dyeing chamber, the tenter-frame, with the textile material in place, is contracted to a predetermined width.

Immediately upon entry of the wetted textile material into the dyeing chamber, an "explosion" occurs; thus causing the yarn, in both the widthwise and lengthwise directions, to become entangled; thus texturizing the yarn in a woven or knitted fabric. It is thus possible to by-pass a separate expensive texturizing process of synthetic materials in yarn form.

EXAMPLE 5

A woven polyamide fabric, constructed with a 60 denier warp and a 70 denier filling weighing 50 grams per square meter, after texturizing as previously described, weighed 86 grams per square meter showing a texturizing and shrinkage of 22% in the warp and 22% in the filling. Another woven polyamide fabric constructed of a 70 denier warp and 70 denier filling weighed 51 grams per square meter before texturizing. After texturizing, it weighed 82 grams per square meter showing a texturizing and shrinkage of 22% in the warp and 17% in the filling.

EXAMPLE 6

A woven polyester fabric, constructed with 3 ply, 100 denier polyester yarn in both warp and filling before texturizing, weighed 115 grams per square meter, and after texturizing, 177 grams per square meter, showing a warp shrinkage of 19% and a filling shrinkage of 18%.

EXAMPLE 7

A woven polyester and wool fabric constructed of 3 ply, 100 denier in the warp and 100% wool in the filling, weighed 139 grams per square meter. After texturizing, it weighed 169 grams per square meter, showing a shrinkage of 18% in the warp and 4% voluminizing of the wool.

EXAMPLE 8

A polyamide, tubular, knitted fabric, constructed of 110 denier yarn, weighed 121 grams per square meter, and after texturizing, the weight was 169 grams per square meter.

EXAMPLE 9

A polyester, tubular, knitted fabric, constructed of 100 denier polyester, weighed 118 grams per square meter, and after texturizing, 198 grams per square meter.

All of the aforementioned fabrics were wetted with a very fine water spray before entering the dyeing chamber.

In all cases the high boiling liquid in the dye chamber was ethylene glycol. The high temperature high boiling liquid was at a temperature of 175° C, while for the polyamide, the temperature of the dyeing liquid was 155° C.

While the textile material was being texturized and voluminized in the dyeing chamber, it was simultaneously heatset; thus saving another expensive operation in conventional fabric finishing.

After this fabric passed through the dyeing chamber, it was then cooled in another chamber and here the excess ethylene glycol was removed from the fabric.

From the cooling chamber, the textile material was washed in methanol. After the methanol wash, the excess methanol was removed and the textile material was then dried at 93° C.

Reference is made to my U.S. Pat. No. 3,530,214 entitled "Method for Treating Textile Materials to Uniformly Set Their Shape"; to my U.S. Pat. No. Re.27,773 entitled "Method for the Continuous Texturizing or Voluminizing of Textile Materials"; and to my U.S. Pat. No. 2,938,811 entitled "Method of Conditioning Polyester Textile Material and the Resulting Products".

Woven polyester fabric constructed with 70 denier polyester yarn in both warp and filling weighed 40 grams per square meter and after texturizing, 61 grams per square meter. The warp showed a texturizing and shrinkage of 20%, while the filling showed 17%. In the previous sample, only clear ethylene glycol was used in the dyeing chamber. In the present sample, 2 grams of Dispersed Blue 56 per liter was added to the ethylene glycol resulting in a deep blue dyeing on the polyester material. Otherwise, the fabric was handled as described before. In one operation, the textile material was texturized, voluminized, heat-set and dyed. The washing of dyed materials in methanol is superior to the use of any other washing or cleaning method. In the case of dyed polyester, it is unnecessary to give a chemical wash to remove excess and unfixed dyestuff to prevent crocking.

A polyamide flat-knotted fabric, constructed of 30 denier polyamide weighing 55 grams before texturizing and 78 grams after texturizing, was exposed in the dyeing chamber at a temperature of 155° C, to ethylene glycol containing 3 grams per liter of Acid Red No. 151. The fabric was dyed a deep red. Here, again, the fabric was texturized, heat-set and dyed in one operation. As mentioned before, the high boiling liquid in all the aforementioned samples was ethylene glycol and in the case of fabrics containing polyester, the temperature was 175° C and in the case of polyamides, the temperature was 155° C. In all the aforementioned examples, the exposure time in the dyeing chamber was 20 seconds. The glycol and methanol were recycled.

In all the aforementioned examples, the fabrics were constructed of untexturized, drawn yarns.

Still further detailed examples are as follows.

EXAMPLE 10

A polyester double knit fabric, 285 grams per linear meter, is dyed continuously in a dye liquor containing ethylene glycol and 1.0 gram per liter (g/l) of Disperse Blue #56 (crude, unstandardized) and 0.5 g/l of phosphoric acid at 175° C for 45 seconds, the dye liquor being applied to the moving web of fabric by spraying from a circulating reservoir of dye liquid at the rate of 375 liters per minute (lpm). The fabric after exposure to the dye liquor is then conducted through a cooling chamber where cool air impinges on the surface of the fabric to lower the temperature of said fabric to 70° C, after which the fabric is washed by spraying with methanol at 10° C to remove residual glycol and surface dye. The fabric is then passed into a drying chamber where hot air at 110° C impinges on both fabric surfaces simultaneously to remove the last traces of methanol. The partially exhausted dye liquor, after addition of makeup ethylene glycol and dye, is returned to the dyeing operation.

Spectrophometric measurement of samples of circulating dye liquor and reflectance measurements of the dyed cloth during the course of dyeing 365 meters of cloth showed a depletion of 15% of the original dyebath concentration due to exhaustion which is made up for by adding to the aforementioned makeup ethylene glycol.

Methanol used in the washing step is collected, along with ethylene glycol and a small amount of dye, and fractionally distilled from the high-boiling glycol and then returned to the washing stage. The residue of the distillation is returned to the dye makeup tank. Methanol was distilled off at the rate of 3,785 liters per hour.

The fabric was overfed into the dyebath by 10% and allowed to shrink 10% in the width-wise direction.

The dyed fabric is a bright blue, uniformly covering the entire fabric surfaces and having excellent fastness properties. Penetration of the fabric and the individual fibers is excellent.

EXAMPLE 11

A nylon type 66 tufted carpet fabric, weighing 625 grams per square meter of surface fiber, is dyed continuously in a dye liquor containing Disperse Blue #56 (crude, unstandardized) and 0.5 g/l phosphoric acid at 155° C for 45 seconds, the dye being applied to the carpet fabric by spraying, followed by cooling, washing and drying in the manner described in Example 5, including recycling of glycol and methanol.

The resultant dyeing is uniformly level.

In practicing this invention, it may also be advantageous to include dyebath additives to impart resistance to ultraviolet degradation of polyester and nylon, improved fastness to light, flame retardance, antistatic, properties, and the like. For example, the following chemical reagents can be added to the dyebath in 2 of FIG. 1 for the following objectives:

Table I

| Reagent | Chemical Composition | Fiber | Advantages |
|---|---|---|---|
| Uvinul D-49 | 2,4-dimethoxy-benzophenone (made by General Aniline & Film (GAF) | Polyester (See U.S. Pat. No. 3,943,105) | Greatly improved light fastness & fabric stability |
| Uvinul D-49 | Do | Polyamide (See U.S. Pat. No. 3,771,949) | Improved light fastness and sunlight stability |
| Tinuvin 327 | Benzotriazole derivative (made by Ciba/Geigy) | Polyamide (See U.S. Pat. No. 3,771,949) | Improved light fastness |
| Uvinul 490 | Benzophenone derivative (made by GAF) | Polyester (See U.S. Pat. No. 3,943,105) | Improved light fastness and fabric stability |
| Anti-Blaze 19 | Chlorinated phosphonate (made by Mobil Chemical Co.) | Polyester Polyamide | Flame retardance |
| Firemaster 200 | Tris-dibromopropyl-phosphate (made by Michigan Chemical Co.) | Polyester Acrylic | Flame retardance |

(See also my U.S. Pat. No. 3,943,105 for additional disclosure relative to ultraviolet absorbers.)

At a later stage of the process, antistatic agents, oil and water repellents, softening and other hand-modifying agents, crease-resisting resins, and the like may be applied to the fabric(s) such as at reference numeral 22 in FIG. 1 of the accompanying drawings (i.e., between methanol washing and drying). These agents may be applied to the washed textile material in the form of a solution or dispersion of the selected agent in a solvent or other suitable carrier.

The following Table II illustrates these treatments:

Table II

| Reagent | Chemical Composition or Other Identification | Fiber(s) | Advantages |
|---|---|---|---|
| Avitex E | Antistatic Agent (made by DuPont) | Cellulosic, animal and synthetic fibers, e.g., Polyamide, Polyester, Acrylic, Olefin, etc. | Excellent antistatic properties even at low humidities |
| Siligan PA | Antistatic Agent (made by BASF Wyandotte) | Do | Do |
| Statexan PKN | Antistatic Agent (made by Bayer Farben Industries) | Do | Do |
| Zepel | Fluorinated Compound (made by DuPont) | Polyamide, Polyester, Acrylic and other cellulosic synthetics, and animal fibers | Excellent oil, water and soil resistance |
| Scotchgard | Fluorocarbon Compound (made by Minnesota Mining & Manufacturing Co.) | Do | Do |
| Avitone A | Hand-modifier (made by DuPont) | Cellulosic | Softening of cellulosic fibers |
| Ceramine HS | Hand-modifier (made by Sandoz Chemical Co.) | Acrylic, Polyamide | Softening Agent |
| Methanol Lubricant K | Hand-modifier (made by DuPont) | Acrylic, Polyamide | Do |
| Aerotex Cream | Melamine-formaldehyde resin (made by American Cyanamid Co.) | Cellulosic and blends of cellulosic with synthetic fibers | Anti-crease properties and stabilization |
| Ahcovel | Synthetic amine formaldehyde resin (made by Imperial Chemical Ind.) | Do | Do |

Table II-continued

| Reagent | Chemical Composition or Other Identification | Fiber(s) | Advantages |
|---|---|---|---|
| Rhonite R-1 | Synthetic amine formaldehyde resin (made by Rohm & Haas Co.) | Do | Do |

It can be seen from the above that the process of this application provides a complete system for dyeing, texturizing and heat-setting, and finishing (and various combinations thereof) of a wide variety of fabrics and blends in a closed continuous environment.

What is claimed is:

1. A process for texturizing and heat-setting textile material containing a low boiling texturizing agent in liquid phase in an amount sufficient to cause flashing of the low boiling texturizing agent upon contact of the thus-treated textile material with a high boiling organic liquid at a relatively high temperature, comprising contacting textile material impregnated with the low boiling liquid texturizing agent with the high boiling organic liquid at a high temperature thus texturizing and heat-setting the textile material, cooling the texturized textile material and washing same with a low boiling organic liquid which is free or substantially free of water, followed by drying the texturized textile material, the washing and drying steps being carried out in an essentially closed system, with the separation and recovery of the low boiling organic wash liquid, low boiling organic wash liquid thus recovered being recycled to the washing step and with the low boiling organic wash liquid vaporized from the textile material during the drying step being recovered, and with the low boiling texturizing agent that is evaporated during the texturizing and heat-setting being removed from the high temperature textile material contacting zone as a mixture thereof with vapor of the high boiling organic liquid.

2. A process as defined in claim 1, wherein the high boiling organic liquid is selected from the class consisting of ethylene glycol, diethylene glycol, triethylene glycol, tetraethylene glycol, propylene glycol, and the methyl- and ethyl- mono- and di-ethers of such glycols.

3. A process as defined in claim 1, wherein the high boiling organic liquid is a lower alkylene glycol.

4. A process as defined in claim 1, wherein the high boiling organic liquid is a lower alkyl ether of a lower alkylene glycol.

5. A process as defined in claim 1, wherein the low boiling organic liquid is a lower alkanol.

6. A process as defined in claim 1, wherein the low boiling organic liquid is methanol.

7. A process as defined in claim 1, wherein the low boiling organic liquid is selected from the class consisting of $CH_2Cl_2$, $CCl_4$ and $CHCl_3$.

8. A process as defined in claim 1, wherein the low boiling organic liquid is a chlorinated paraffinic hydrocarbon.

9. A process as defined in claim 1, wherein the high boiling organic liquid contains a suitable dyestuff dissolved, suspended or dispersed therein, whereby the textile material is texturized, heat-set and dyed simultaneously.

10. A process as defined in claim 9, wherein the high boiling organic liquid is selected from the class consisting of ethylene glycol, diethylene glycol, triethylene glycol, tetraethylene glycol, propylene glycol, and the methyl- and ethyl- mono- and di-ethers of such glycols.

11. A process as defined in claim 10, wherein the high boiling organic liquid is a lower alkylene glycol.

12. A process as defined in claim 10, wherein the high boiling organic liquid is a lower alkyl ether of a lower alkylene glycol.

13. A process as defined in claim 10, wherein the low boiling organic liquid is a lower alkanol.

14. A process as defined in claim 10, wherein the low boiling organic liquid is methanol.

15. A process as defined in claim 10, wherein the low boiling organic liquid is selected from the class consisting of $CH_2Cl_2$, $CCl_4$ and $CHCl_3$.

16. A process as defined in claim 10, wherein the low boiling organic liquid is a chlorinated paraffinic hydrocarbon.

17. A process as defined in claim 1, wherein the textile material is treated while in a substantially relaxed or untensioned condition.

18. A process as defined in claim 9, wherein the textile material is treated while in a substantially relaxed or untensioned condition.

19. A process as defined in claim 1, wherein one or more additives for imparting resistance to ultraviolet degradation, improved fastness to light, flame retardance or antistatic properties are added to the high boiling liquid.

20. A process as defined in claim 9, wherein one or more additives for imparting resistance to ultraviolet degradation, improved fastness to light, flame retardance or antistatic properties are added to the high boiling liquid.

21. A process as defined in claim 1, wherein one or more additives for imparting antistatic properties, oil and/or water repellency, softening properties, or crease-resistance are applied to the textile material after washing and before drying.

22. A process as defined in claim 9, wherein one or more additives for imparting antistatic properties, oil and/or water repellency, softening properties, or crease-resistance are applied to the textile material after washing and before drying.

* * * * *